US008077017B2

(12) United States Patent
Kennedy

(10) Patent No.: US 8,077,017 B2
(45) Date of Patent: Dec. 13, 2011

(54) LASER-AID FIRE EVACUATION GUIDANCE SYSTEM

(75) Inventor: Richard Kennedy, Tecumseh (CA)

(73) Assignee: Richard Kennedy, Ontario (CA)

( * ) Notice: Subject to any disclaimer, the term of this patent is extended or adjusted under 35 U.S.C. 154(b) by 636 days.

(21) Appl. No.: 11/795,344

(22) PCT Filed: Jan. 12, 2006

(86) PCT No.: PCT/IB2006/000047

§ 371 (c)(1),
(2), (4) Date: Jul. 16, 2007

(87) PCT Pub. No.: WO2006/077475

PCT Pub. Date: Jul. 27, 2006

(65) Prior Publication Data

US 2008/0266065 A1 Oct. 30, 2008

Related U.S. Application Data

(60) Provisional application No. 60/644,714, filed on Jan. 18, 2005.

(51) Int. Cl.
*G08B 3/00* (2006.01)

(52) U.S. Cl. ..... 340/328; 340/332

(58) Field of Classification Search ..... 340/628, 340/332, 691.1, 328
See application file for complete search history.

(56) References Cited

U.S. PATENT DOCUMENTS

| | | | | |
|---|---|---|---|---|
| 5,140,301 | A * | 8/1992 | Watanabe | 340/332 |
| 5,575,550 | A * | 11/1996 | Appeldorn et al. | 362/559 |
| 6,150,943 | A * | 11/2000 | Lehman et al. | 340/628 |
| 2004/0149860 | A1 | 8/2004 | LeCroy, Jr. | |
| 2006/0071802 | A1 * | 4/2006 | Right et al. | 340/628 |

* cited by examiner

*Primary Examiner* — Shirley Lu
(74) *Attorney, Agent, or Firm* — Harness, Dickey & Pierce, P.L.C.

(57) ABSTRACT

A fire evacuation guidance system includes a pair of dissimilarly colored laser beams generated by at least one laser emitting device. The dissimilarly colored laser beams are generated substantially parallel to hallways of a (5) structure and subsequently reflected, where required, to direct occupants to a shortest exit route in the event of a fire emergency. That is, a first laser beam of one color is generated substantially parallel to one side of a hallway while a second laser beam of a second color different from the first color is generated substantially parallel to the opposite side of the hallway. So long as an occupant (10) of the structure positions himself or herself between the two laser beams and keeps the laser beam of the first color on his or her right hand side, the occupant will be directed to the closest exit in the event of a fire emergency.

5 Claims, 1 Drawing Sheet

LASER-AID FIRE EVACUATION GUIDANCE SYSTEM

CROSS-REFERENCE TO RELATED APPLICATIONS

Figure 1:
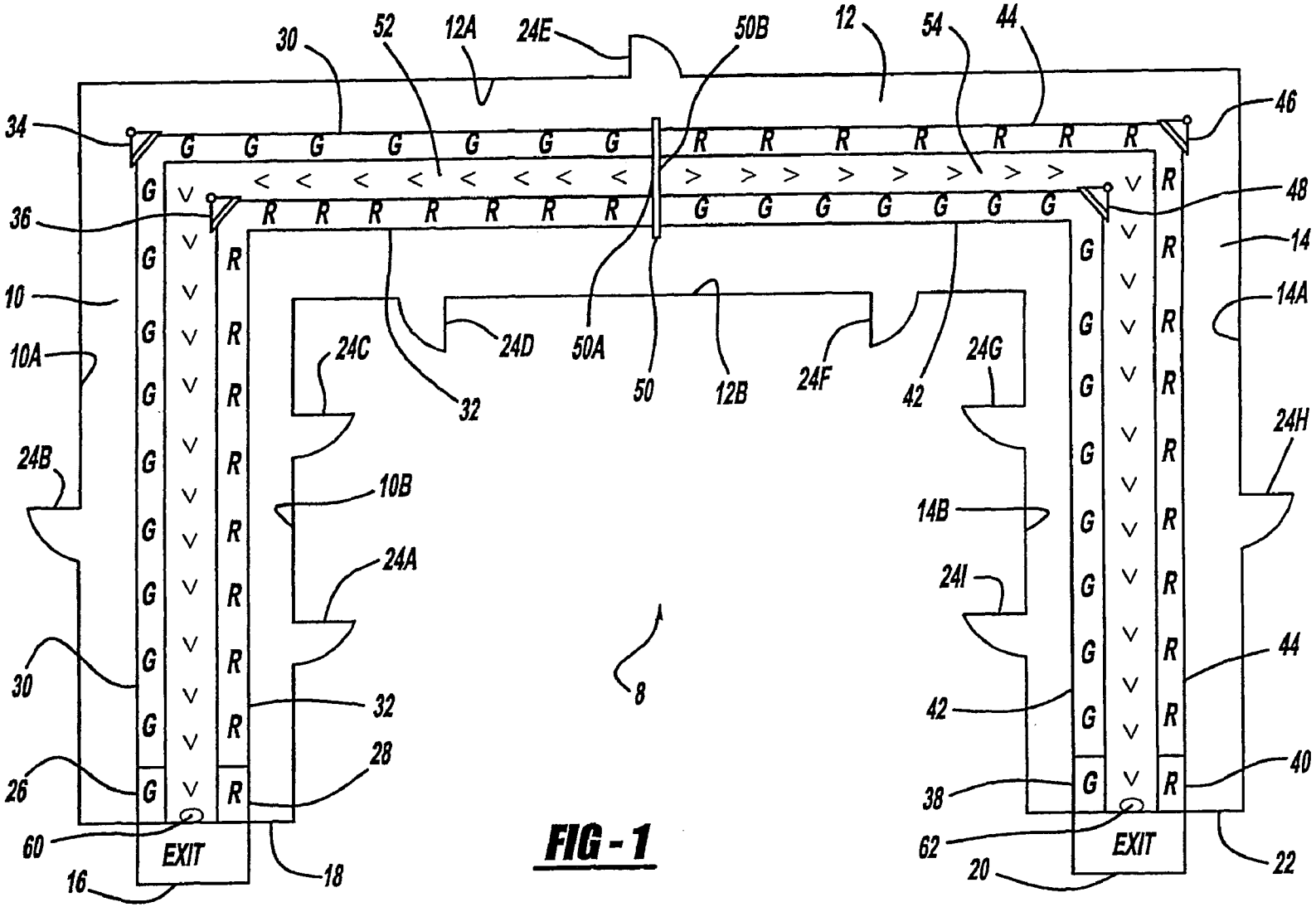

This application is a 371 US National Stage of International application No. PCT/IB2006/000047, filed Jan. 12, 2006. This application claims the benefit of U.S. Provisional Application No. 60/644,714, filed on Jan. 18, 2005. The disclosures of the above applications are incorporated herein by reference.

BACKGROUND

The statements in this section merely provide background information related to the present disclosure and may not constitute prior art.

This application relates generally to a fire evacuation system, and more particularly to an indoor fire evacuation system that incorporates lasers of different colors as a navigational tool to guide building occupants to the closest emergency exit during a fire emergency.

In a fire emergency, smoke inhalation, not the fire itself, is the largest cause of death. As such, in the event of a fire emergency, it is imperative to evacuate all occupants as quickly and efficiently as possible to minimize the risk of smoke inhalation. Typically, in the event of a fire, a structure, such as a building, has a fire detection system that is activated either automatically, by a smoke detector or manually, by an individual pulling a fire alarm. Upon activation, the fire detection system then triggers an audible alarm that provides notification to the occupants of the structure of the need to evacuate. Upon notification, the occupant typically relies on illuminated "EXIT" signs that are located throughout the structure to indicate an available exit.

In most complex structures, however, more than one illuminated "EXIT" sign may be visible to an individual at any one time. In addition, each of these visible illuminated "EXIT" signs may be located at different ends of the structure. This can be confusing and/or misleading to the individual especially in an emergency situation. That is, the individual may not know which sign represents the shortest, quickest route to safety. Furthermore, the illuminated "EXIT" signs may not even be visible to the individual as they easily can be obscured from view completely by smoke. As such, known fire detection systems may also include additional features or be in communication with additional systems that assist in the evacuation of the individual by providing some means of guiding the individual toward a specific exit during a fire emergency.

While numerous systems do exist to assist in the evacuation of individuals from a structure, such as a building, in the event of fire emergency, the systems are typically complex and costly. Examples of known evacuation guidance systems include incorporating sequenced vertical columns of laser light that increase in intensity as the individual approaches an exit, incorporating a single-color laser into a smoke detector to direct individuals to an exit, and incorporating a laser diode image projector that projects successive images along an escape path. While these known systems do provide some assistance, they are extremely complex and costly. That is, the smoke-detector mounted laser at least requires replacement of all existing smoke detectors while both the sequencing system and the projecting system require the addition of extensive hardware, all of which may result in significant capital expenditures. Further, these systems only show a path to each exit available. As such, in larger structures with multiple exit possibilities, the individual may again encounter a multiple of different paths with no indication of which path leads to the closest exit. As such it is desirable to provide a less complex, cost-effective fire evacuation guidance system that clearly and unambiguously directs an individual to the closest emergency exit during a fire emergency.

DRAWINGS

The drawings described herein are for illustration purposes only and are not intended to limit the scope of the present disclosure in any way.

FIG. 1 shows a plan view of a u-shaped portion of a hallway on one floor of a building including one embodiment of the present invention.

DETAILED DESCRIPTION

The following description is merely exemplary in nature and is not intended to limit the present disclosure, application, or uses.

FIG. 1 shows a plan view of a u-shaped portion of a hallway of one floor of a building including one embodiment of a fire evacuation guidance system 8 of the present invention. A first hallway 10 is substantially perpendicular to a second hallway 12 and the second hallway 12 is substantially perpendicular to a third hallway 14. Further, the first hallway 10, the second hallway 12, and the third hallway 14 form a u-shape. A first exit 16 is located at a first end 18 of the first hallway 10 and a second exit 20 is located at a second end 22 of the third hallway 14. During a fire emergency, the first exit 16 and the second exit 20 are both available for use by the occupants of a plurality of rooms (not shown), which are associated with a plurality of doors 24A-24I.

A first green laser emitting device 26 and a first red laser emitting device 28 are installed proximate to the first exit 16. The first green laser emitting device 26 is operable to emit a first green laser beam 30 down along and substantially parallel to the first hallway 10. The first red laser emitting device 28 is operable to emit a first red laser beam 32 down along and substantially parallel to the first hallway 10. The first green laser beam 30 is biased toward a first outside wall 10A of the first hallway 10 whereas the first red laser beam 32 is biased toward a first inside wall 10B of the first hallway 10. Further, the first green laser beam 30 and the first red laser beam 32 are substantially parallel to one another in the first hallway 10.

The first green laser beam 30 and the first red laser beam 32 can be continuously on or one of the first green laser beam 30 or the first red laser beam 32 can be pulsed in order to accommodate people who suffer from color blindness.

A first reflective device 34, for example a mirror, is located at the intersection of the first hallway 10 and the second hallway 12. The first reflective device 34 is positioned to alter the path of the first green laser beam 30, by reflecting the first green laser beam 30 to be substantially parallel to the second hallway 12. The first green laser beam 30 is then reflected down along and substantially parallel to the second hallway 12. The first green laser beam 30 is now biased toward a second outside wall portion 12A of the second hallway 12.

A second reflective device 36, for example a mirror, is located at the intersection of the first hallway 10 and the second hallway 12. The first reflective device 34 is positioned to alter the path of the first red laser beam 32, by reflecting the first red laser beam 32 to be substantially parallel to the second hallway 12. The first red laser beam 32 is then reflected down along and substantially parallel to the second hallway 12. The first red laser beam 32 is now biased toward a second inside wall portion 12B of the second hallway 12. Further, the first green laser beam 30 and the first red laser beam 32 remain substantially parallel to one another in the second hallway 12.

A second green laser emitting device 38 and a second red laser emitting device 40 are installed proximate to the second exit 20. The second green laser emitting device 38 is operable to emit a second green laser beam 42 down along and substantially parallel to the third hallway 14. The second red laser emitting device 40 is operable to emit a second red laser beam 44 down along and substantially parallel to the third hallway 14. The second green laser beam 42 is biased toward a third outside wall 14A of the third hallway 14 whereas the second red laser beam 44 is biased toward a third inside wall 14B of the third hallway 14. Further, the second green laser beam 42 and the second red laser beam 44 are substantially parallel to one another in the third hallway 14.

The second green laser beam 42 and the second red laser beam 44 can be continuously on or one of the second green laser beam 42 or the second red laser beam 44 can be pulsed in order to accommodate people who suffer from color blindness.

A third reflective device 46, for example a mirror, is located at the intersection of the third hallway 14 and the second hallway 12. The third reflective device 46 is positioned to alter the path of the second red laser beam 44, by reflecting the second red laser beam 44 to be substantially parallel to the second hallway 12. The second red laser beam 44 is then reflected down along and substantially parallel to the second hallway 12. The second red laser beam 44 is now biased toward the second outside wall portion 12A of the second hallway 12.

A fourth reflective device 48, for example a mirror, is located at the intersection of the third hallway 14 and the second hallway 12. The fourth reflective device 48 is positioned to alter the path of the second green laser beam 42, by reflecting the second green laser beam 42 to be substantially parallel to the second hallway 12. The second green laser beam 42 is then reflected down along and substantially parallel to the second hallway 12. The second green laser beam 42 is now biased toward the second inside wall portion 12B of the second hallway 12. Further, the second green laser beam 42 and the second red laser beam 44 remain substantially parallel to one another in the second hallway 12.

A blocking device 50 is located such that the linear distance from the first exit 16 to the blocking device 50 and the linear distance from the second exit 20 to the blocking device is substantially equal. The blocking device includes a first blocking surface portion 50A and a second blocking surface portion 50B. Both the first green laser beam 30 and the first red laser beam 32 terminate at a location in which they make respective contact with the first blocking surface portion 50A of the blocking device 50. Both the second green laser beam 42 and the second red laser beam 44 terminate at a location in which they make respective contact with the second blocking surface portion 50B of the blocking device 50.

In the event of a fire emergency the first green laser beam 30 and the first red laser beam 32 generate a first evacuation path 52 and the second green laser beam 42 and the second red laser beam 44 generate a second evacuation path 54. Based upon which of the plurality of doors 24A-24I the occupant comes out of, either the first evacuation path 52 or the second evacuation path 54 is to be used as an evacuation route in the event of a fire emergency. Further, so long as each occupant keeps the green laser beam 30 or 42 on his or her right hand side, the evacuation path 52 or 54 will lead him or her to the closest emergency exit. For example, during a fire emergency, an occupant exiting a room associated with door 24A would see the first evacuation path 52 generated by the first green laser beam 30 and the first red laser beam 32. By placing himself or herself between the first green laser beam 30 and the first red laser beam 32 and positioning himself or herself such that the first green laser beam 30 is on his or her right hand side, the first evacuation path 52 would direct the occupant to the first exit 16, which is the emergency exit closest to these rooms. Similarly, an occupant exiting a room associated with any of doors 24B, 24C or 25D would also use the first evacuation path 52, again keeping the first green laser beam 30 on his or her right hand side. Further, an occupant exiting an a room associated with any of the doors 24F, 24G, 24H or 24I, would use the second evacuation path 54 generated by the second green laser beam 42 and the second red laser beam 44. By keeping the second green laser beam 42 on his or her right hand side, the second evacuation path 54 would lead the occupant to the second exit 20, which is the emergency exit closest to these rooms. Finally, an occupant in a room associated with door 24E would have the option of following either the first evacuation path 52 to the first exit 16 or the second evacuation path 54 to the second exit 20, as the distance to the first exit 16 and to the second exit 20 would be substantially the same from the room associated with door 24E.

Fire evacuation guidance system 8 can also be used to facilitate the movement of the emergency personnel. Assuming the emergency personnel feel a search of the building is necessary, they can enter one of the exits and by positioning himself or herself such that one of the red laser beams 32 or 44 is on his or her right side (or the green laser beams 30 and 42 are on his or her left side), they can be directed into the building to complete the search. Once the emergency personnel reach blocking device 50, they can either continue to the opposite exit or turn around and proceed to their original exit. Either way, by positioning green laser beams 30 and 42 on their right side (or the red laser beams 32 or 44 on their left side) they will be directed to the appropriate exit.

A sensing device 60 is illustrated in FIG. 1 at a position adjacent exit 16 and a sensing device 62 is illustrated at a position adjacent exit 20. Sensing devices 60, 62 and laser emitting devices 26, 28, 38 and 40 are connected to a central control system (not shown). In the event of an emergency, if the sensing device 60 senses an unsafe condition at exit 16, such as excess heat during a fire emergency, the colors of laser beams 30 and 32 can be reversed such that a person is directed towards blocking device 50 and then towards exit 20 by laser beams 42 and 44.

In a similar manner, in the event of an emergency, if sensing device 62 senses an unsafe condition at exit 20, such as excess heat during a fire emergency, the colors of laser beams 42 and 44 can be reversed such that a person is directed towards blocking device 50 and then towards exit 16 by laser beams 30 and 32.

Further, the fire evacuation guidance system 8 of the present invention, is powered by traditional means, that is by direct connection to a structure's primary electrical source. In addition, the fire evacuation guidance system 8 may also be selectively coupled to a back-up source, for example a battery, in case of a power outage.

While the two laser beams described in a preferred embodiment are of red and green color, it is to be understood that the laser beams, may be of any combination of colors, so long as the two colors are dissimilar from one another. Further, although a preferred embodiment of this invention has been disclosed, a worker of ordinary skill in this art would recognize that certain modifications would come within the scope of this invention. For that reason, the following claims should be studied to determine the true scope and content of this invention.

While the laser emitting devices have been illustrated as being adjacent exits 16 and 20 and projecting a laser beam to blocking device 50, it is within the scope of the present invention to position the laser emitting devices in the center of the hallway and project the laser beam toward the exit if desired.

While the laser emitting devices have been illustrated as being a single laser beam or opposite sides of a hallway, it is within the scope of the present invention to have a different number of laser beams on the opposite sides of the hallway. For example, one side of the hallway could have two laser beams while the opposite side could have one laser beam. This system would allow for exit route guidance without the need for different colored lasers but different colored lasers could also be included in this system.

While the laser emitting devices have been illustrated as being parallel with each other and with the hallway, it is within the scope of the present invention to have non-parallel beams that are not parallel with each other and not parallel with the walls. For example, converging beams could lead to an exit door. This system may allow for exit route guidance without the need for different colored lasers but different colored lasers could also be included with this system.

What is claimed is:

1. An evacuation guidance system in combination with a building having a hallway leading to an exit, the fire evacuation guidance system comprising:

a first laser emitting device emitting a first laser beam of a first color, the first laser emitting device and the first laser beam being located at a first side of the hallway defining a path, the first laser beam being located adjacent the exit;

a second laser emitting device emitting a second laser beam of a second color different from the first color, the second laser beam being located at a second side of the hallway opposite the first side of the hallway, the second laser emitting device and the second laser beam being located adjacent the exit, said first and second laser beams are parallel to each other; and a first reflective device and a second reflective device, the first laser beam being directed around a turn in the hallway by the first reflective device, the second laser beam being directed around the turn in the hallway by the second reflective device; wherein said first color of said first laser beam on one side of the path and the second color of the second laser beam is on an opposite side of the path to orient a user by placing the user between the two laser beams such that the first color laser beam is on the user's right hand side, the user is directed along the evacuation path to the exit so that the first and second laser beams are indicative of a direction toward the exit; and a sensing device disposed adjacent the exit, the sensing device reversing the colors of the first and second laser beams when an unsafe condition is sensed at the exit wherein the second laser beam becomes the first color and the first laser beam becomes the second color, the first color of the second laser beam being indicative of a direction away from the exit.

2. The evacuation guidance system according to claim 1, wherein the first and second redirected beams are parallel to each other.

3. The evacuation guidance system according to claim 1, wherein the first laser beam is a pulsed beam.

4. The evacuation guidance system according to claim 1, wherein one of the first laser beam or the second laser beam is a pulsed beam.

5. The evacuation guidance system according to claim 1, wherein the first color is green and the second color is red.

* * * * *